US008851453B2

(12) United States Patent
de Zwart

(10) Patent No.: US 8,851,453 B2
(45) Date of Patent: Oct. 7, 2014

(54) SLIDEGATE OPENING SYSTEM

(75) Inventor: Henk de Zwart, League City, TX (US)

(73) Assignee: Chep Technology Pty Limited, Sydney NSW (AU)

( * ) Notice: Subject to any disclaimer, the term of this patent is extended or adjusted under 35 U.S.C. 154(b) by 719 days.

(21) Appl. No.: 13/118,756

(22) Filed: May 31, 2011

(65) Prior Publication Data

US 2011/0289851 A1 Dec. 1, 2011

Related U.S. Application Data

(60) Provisional application No. 61/350,014, filed on May 31, 2010.

(51) Int. Cl.
*B66F 3/00* (2006.01)
*B65D 90/66* (2006.01)
*E05F 9/00* (2006.01)

(52) U.S. Cl.
CPC . *E05F 9/00* (2013.01); *B65D 90/66* (2013.01); *B65D 2590/664* (2013.01); *E05Y 2900/604* (2013.01)
USPC ..... 254/131; 280/433; 49/122; 49/358

(58) Field of Classification Search
CPC ..... B66F 15/00; B62D 53/068; B62D 53/08; B62D 53/0857; B62D 53/061; B62D 53/0814; B62D 63/08
USPC ..... 29/270, 244; 254/113, 131; 49/358, 49/359, 363
See application file for complete search history.

(56) References Cited

U.S. PATENT DOCUMENTS

| | | | | | |
|---|---|---|---|---|---|
| 1,219,948 | A | * | 3/1917 | Kaehler | 254/131 |
| 1,807,142 | A | * | 5/1931 | Achenbach | 254/119 |
| 2,252,797 | A | * | 8/1941 | Allen | 254/131 |
| 2,729,990 | A | * | 1/1956 | Ballman | 254/113 |
| 2,846,213 | A | * | 8/1958 | Murphy | 49/122 |
| 2,930,583 | A | * | 3/1960 | Noe et al. | 254/113 |
| 3,436,778 | A | * | 4/1969 | Stevens et al. | 114/343 |
| 4,251,089 | A | * | 2/1981 | Skaggs | 280/433 |
| 4,738,433 | A | * | 4/1988 | Hoff | 254/30 |
| 5,326,144 | A | * | 7/1994 | Forcier | 294/219 |
| 5,423,567 | A | * | 6/1995 | Upton | 280/433 |
| 5,462,385 | A | * | 10/1995 | Mohlengraft | 404/25 |
| 5,505,433 | A | * | 4/1996 | Carmichael et al. | 254/211 |
| D377,924 | S | * | 2/1997 | Christensen | D12/161 |
| 5,755,470 | A | * | 5/1998 | Schempp | 294/17 |
| 5,803,518 | A | * | 9/1998 | Gibbons | 294/18 |
| 5,863,060 | A | * | 1/1999 | Hollis et al. | 280/433 |
| 5,988,951 | A | * | 11/1999 | DiFrank et al. | 406/32 |
| 6,059,372 | A | * | 5/2000 | McDonald et al. | 298/8 H |
| 6,201,252 | B1 | * | 3/2001 | Hollis et al. | 250/433 |
| 6,202,510 | B1 | * | 3/2001 | Kupelian | 81/15.7 |

(Continued)

*Primary Examiner* — Lee D Wilson
*Assistant Examiner* — Jamal Daniel
(74) *Attorney, Agent, or Firm* — Ido Tuchman

(57) ABSTRACT

A system to open a shipping bin slide-gate may include an opener, a pivot point towards one end of the opener, and a handle towards the other end of the opener. The system may also include a puller, a connector towards one end of the puller, and a joiner towards the other end of the puller that connects to the opener. The system may further include an attacher that engages a shipping container and the pivot point, and the attacher transmits a force applied at the handle to the connector to open the slide-gate carried by the shipping container.

20 Claims, 13 Drawing Sheets

(56) References Cited

U.S. PATENT DOCUMENTS

| | | | | |
|---|---|---|---|---|
| 6,354,642 | B1 * | 3/2002 | Haggerty | 294/210 |
| 6,375,162 | B1 * | 4/2002 | Johnson | 254/131 |
| 6,857,176 | B2 * | 2/2005 | Machado | 29/426.5 |
| 6,899,038 | B2 * | 5/2005 | Fortuna | 105/282.3 |
| 6,951,332 | B2 * | 10/2005 | Zimmerman | 254/131 |
| 6,964,407 | B1 * | 11/2005 | Butler | 254/131 |
| 7,325,822 | B1 * | 2/2008 | Humphreys et al. | 280/149.2 |
| 7,347,467 | B2 * | 3/2008 | Theobald | 294/24 |
| 7,416,233 | B2 * | 8/2008 | Hinson | 294/26 |
| 7,587,800 | B2 * | 9/2009 | Dasbach et al. | 29/267 |
| 7,591,336 | B2 * | 9/2009 | Hackmann | 180/209 |
| 7,621,551 | B1 * | 11/2009 | Forbes, Jr. | 280/441.2 |
| 7,762,529 | B1 * | 7/2010 | Scott | 254/120 |
| 8,240,017 | B2 * | 8/2012 | Dasbach et al. | 29/267 |
| 8,322,688 | B2 * | 12/2012 | Hebert | 254/131 |
| 2005/0161994 | A1 * | 7/2005 | Heider et al. | 298/27 |
| 2007/0181032 | A1 * | 8/2007 | Brandt | 104/29 |
| 2011/0041584 | A1 * | 2/2011 | Kiefer et al. | 72/458 |
| 2011/0289851 | A1 * | 12/2011 | de Zwart | 49/358 |

* cited by examiner

SLIDEGATE OPENING SYSTEM

CROSS-REFERENCE TO RELATED APPLICATIONS

This patent application claims priority under 35 U.S.C. §120 to Provisional Patent Application No. 61/350,014 filed May 31, 2010, titled "SLIDE GATE OPENING SYSTEM" and incorporated herein by reference in its entirety.

BACKGROUND

The invention relates to the field of shipping, and, more particularly, to tools for shipping bins.

FIG. 1 is an example of a prior art shipping bin, container, and/or the like, that is used for transporting liquids and/or flowable solids such as grains, sand, catalyst, plastic pellets, particular chemical solids, and/or the like. The shipping bin may have a slide-gate on their bottom surface used to discharge the transported load carried by the shipping bin.

SUMMARY

According to one embodiment of the invention, a system to open a shipping bin slide-gate may include an opener, a pivot point towards one end of the opener, and a handle towards the other end of the opener. The system may also include a puller, a connector towards one end of the puller, and a joiner towards the other end of the puller that connects to the opener. The system may further include an attacher that engages a shipping container and the pivot point, and the attacher transmits a force applied at the handle to the connector to open the slide-gate carried by the shipping container.

The joiner may provide an adjustable connection to the opener. The system may additionally include a receiver carried by the attacher that is sized to securely engage the pivot point, and the receiver enables the pivot point to rotate within the receiver. The receiver may be a female fitting that mates with the pivot point which may be a male fitting.

The system may also include an attachment portion carried by the attacher, and the attachment portion sized to securely engage a forklift pocket of the shipping container in a first position and to be disengaged from the forklift pocket in a second position. The attachment portion may envelope a portion of a single side of the forklift pocket.

The attacher may include a first section that carries an attachment portion, a second section that carries a receiver, the first section connects to the second section, and the first section and the second section are not parallel to each other. The system may further include a buttress that strengthens the connection between the first section and the second section. The connector may extend into a handhold on the slide-gate to enable the puller to actuate the slide-gate.

Another aspect of the invention is a method to open a shipping bin slide-gate that may include securely positioning an attacher in a forklift pocket of a shipping container. The method may also include connecting an opener to the attacher and a slide-gate of a shipping container. The method may further include applying a force to the opener to actuate the slide-gate.

The method may additionally include applying the force to a handle carried by the opener that is transmitted to the slide-gate through a pivot point and a puller. The method may also include rotating the pivot point within a receiver carried by the attacher to transmit the force. The method may further include connecting a puller carried by the opener to the slide-gate to transmit the force applied to the opener to the slide-gate.

Another aspect of the invention is a system to open a shipping bin slide-gate that may include an opener, a pivot point towards one end of the opener, and a handle towards the other end of the opener. The system may also include a puller, a connector towards one end of the puller and the connector extends into a handhold on a slide-gate to enable the puller to actuate the slide-gate, and a joiner towards the other end of the puller that connects to the opener. The system may further include an attacher that engages a shipping container and the pivot point, and the attacher transmits a force applied at the handle to the connector to open the slide-gate carried by the shipping container. The system may additionally include a receiver carried by the attacher that is sized to securely engage the pivot point, and the receiver enables the pivot point to rotate within the receiver.

DETAILED DESCRIPTION

The invention will now be described more fully hereinafter with reference to the accompanying drawings, in which preferred embodiments of the invention are shown. Like numbers refer to like elements throughout.

Figure 1:
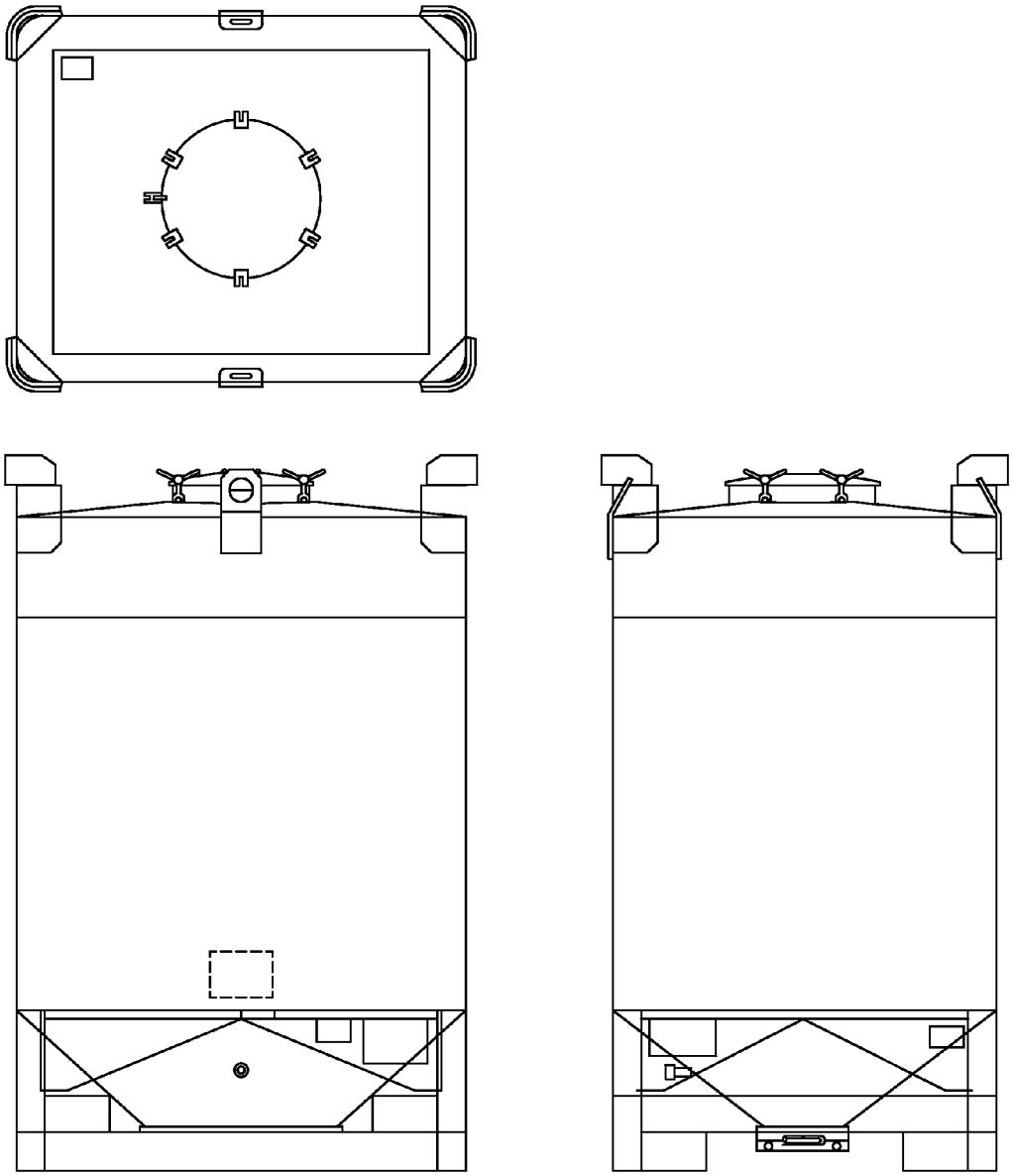
FIG.1 Prior Art
FIG. 1 includes isometric views of an embodiment of a shipping bin.
Figure 2:
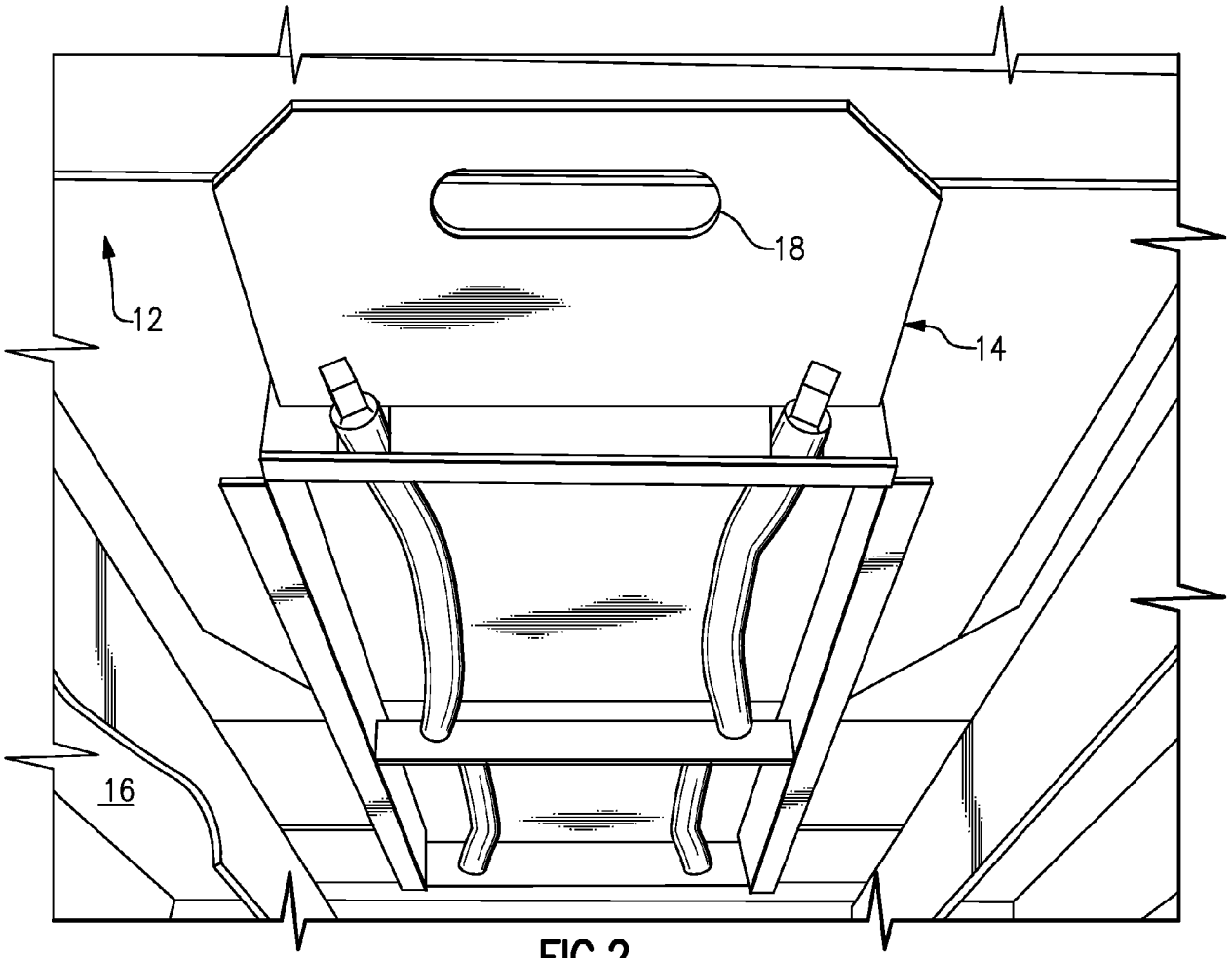
FIG.2 Prior Art
FIG. 2 illustrates a bottom view of a prior art slide-gate on the shipping bin of FIG. 1.
Figure 3:
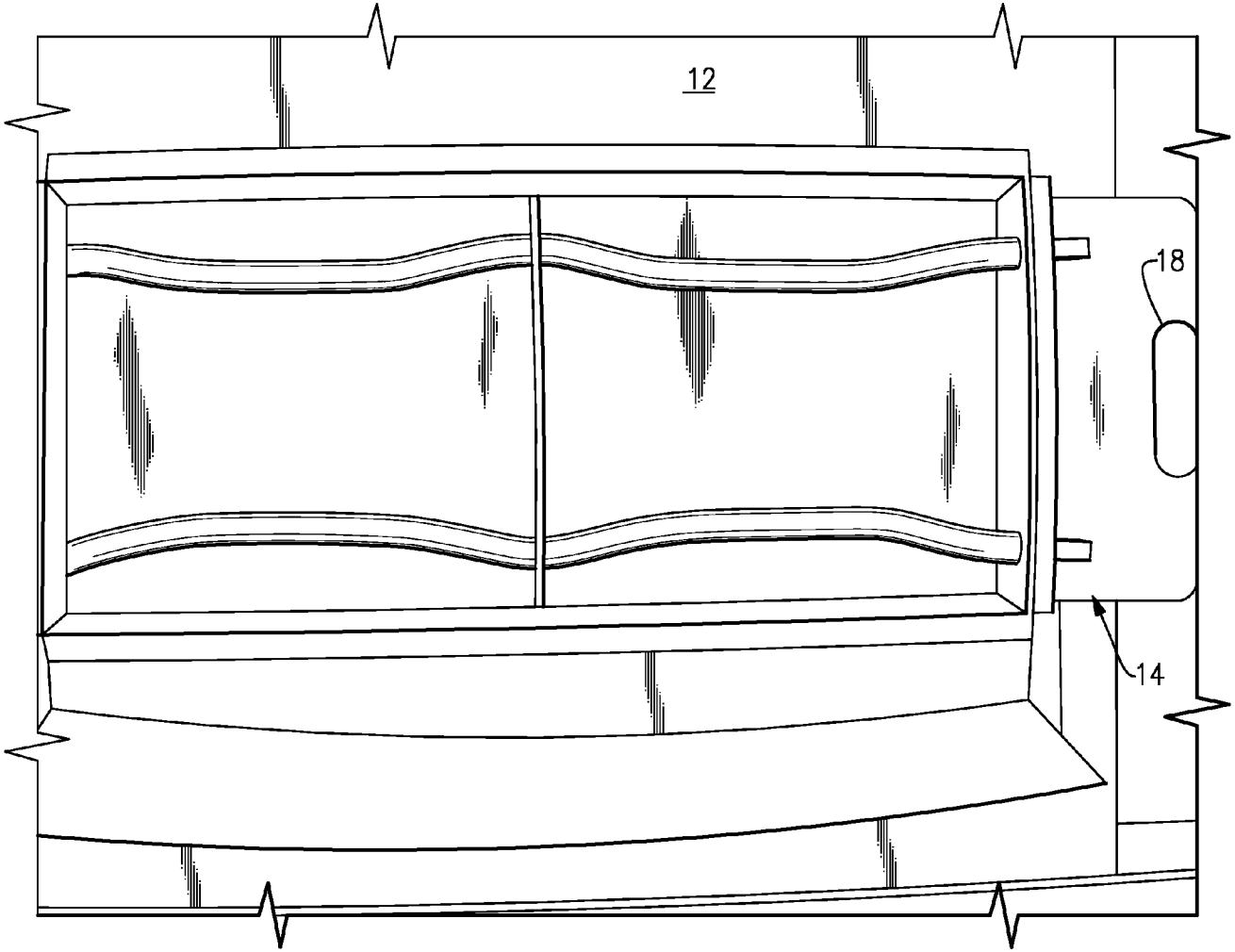
FIG.3 Prior Art
FIG. 3 illustrates an alternative bottom view of the prior art slide-gate of FIG. 2.

With reference to FIGS. 2 and 3, prior art shipping bins 12, containers, and/or the like, for liquids and/or flowable solids such as grains, sand, catalyst, plastic pellets, particular chemical solids, and/or the like may have a slide-gate 14 on their bottom surface. The slide-gate 14 covers an opening on the bottom of the shipping bin 12 in the closed position, and uncovers the opening on the bottom of the shipping bin 12 in the open position. When the slide-gate 14 is in the open position, gravity drives the liquid and/or flowable solid out of the shipping bin 12 as will be appreciated by those of skill in the art.

The shipping bin 12 may also include a forklift pocket 16. The tines of a forklift (not shown) engage the forklift pocket 16 to aid in moving the shipping bin 12 from one location to another location. The slide-gate 14 may also include a handhold 18 to aid a user in moving the slide-gate from the closed position to the open position and vice versa. Under certain circumstances, the slide-gate 14 may be difficult to open, even when the user uses the handhold 18.

Figure 4:
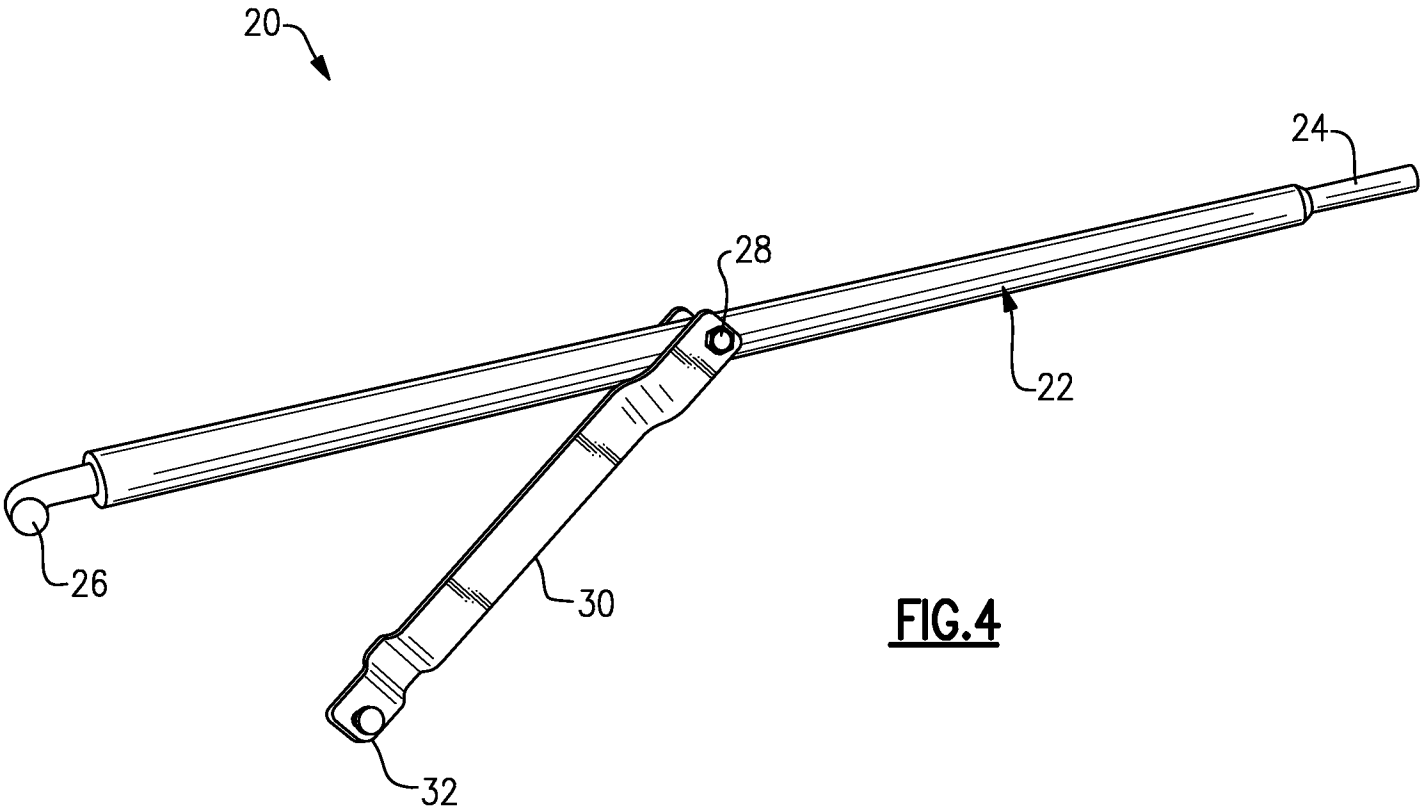
FIG. 4 illustrates the opener of a slide-gate opening system in accordance with the invention.

With additional reference to FIG. 4, an opener 20 that may aid in opening a slide-gate 14 that is difficult to open is initially described. In one embodiment, the opener 20 includes an opener member 22 with a handle 24 on one end and a pivot point 26 on the other end. In another embodiment, the opener 20 further includes a joiner 28 located between the handle 24 and the pivot point 26.

In one embodiment, the joiner 28 connects opening member 22 with one end of puller 30. In another embodiment, the other end of puller 30 includes a connector 32. The opener 20 and its respective subcomponents may be made of any substantially rigid material such as metal, a composite layup, and/or the like.

Figure 5:
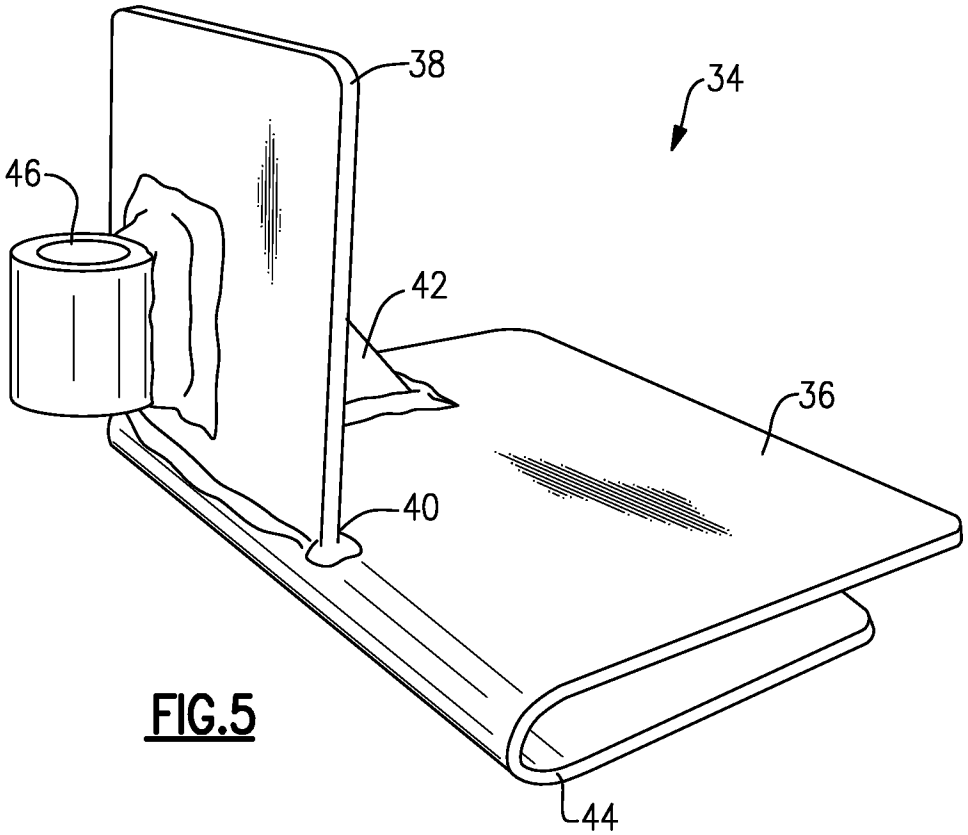
FIG. 5 illustrates the attacher of a slide-gate opening system in accordance with the invention.
Figure 6:
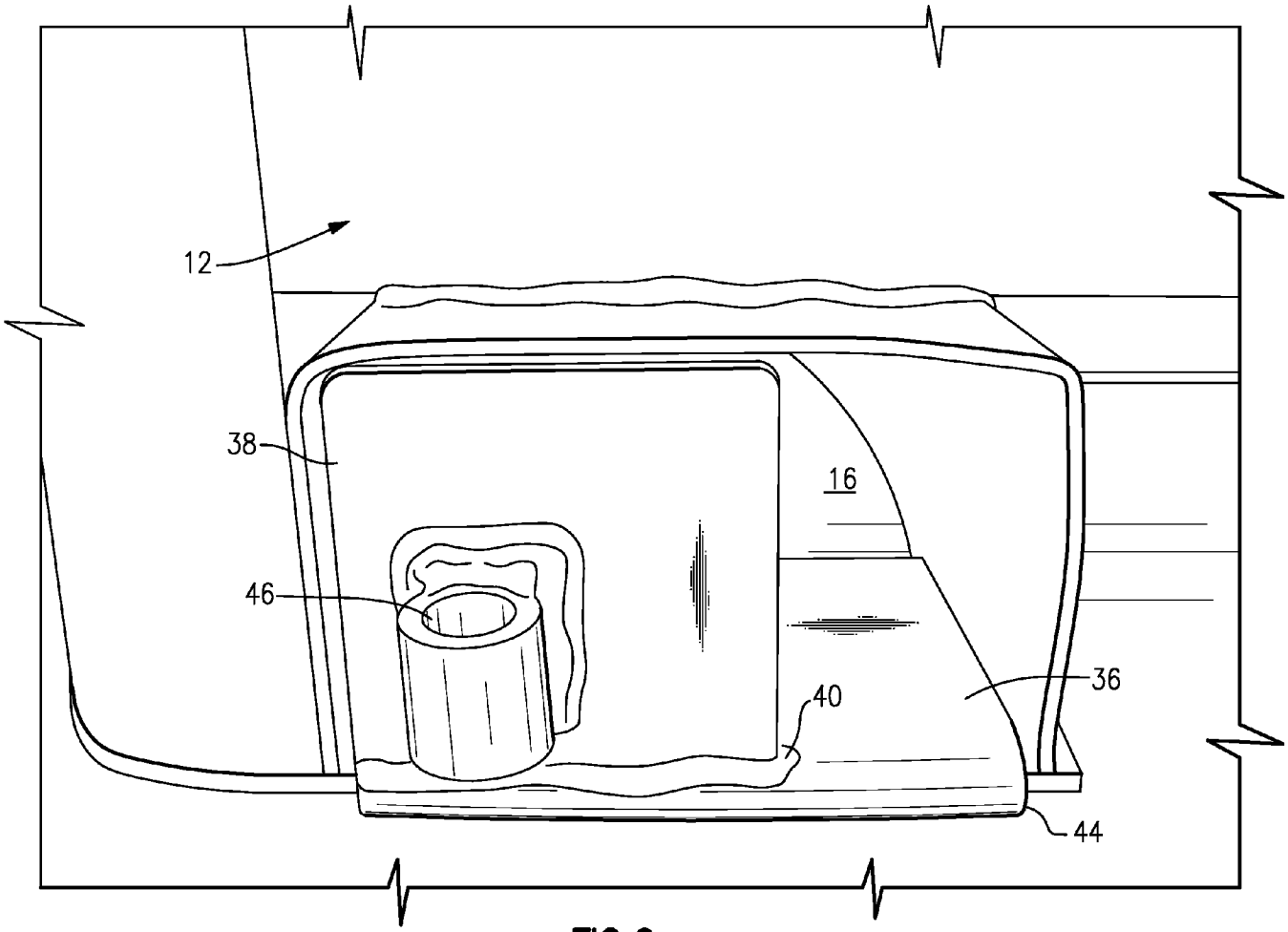
FIG. 6 illustrates the attacher of FIG. 5 in its usage position in accordance with the invention.

With additional reference to FIGS. 5 and 6, an attacher 34 is initially described. In one embodiment, the attacher 34 includes a first section 36 that abuts a second section 38. In another embodiment, the abutment joint 40 between first section 36 and second section 38 is supported by a buttress 42 that connects the first section and second sections as will be appreciated by those of skill in the art.

In one embodiment, the first section 36 includes an attachment portion 44 that is used to connect the attacher 34 to shipping bin 12. In another embodiment, the second section 38 includes a receiver 46. The attacher 34 and its respective subcomponents may be made of any substantially rigid material such as metal, a composite layup, and/or the like.

Figure 7:
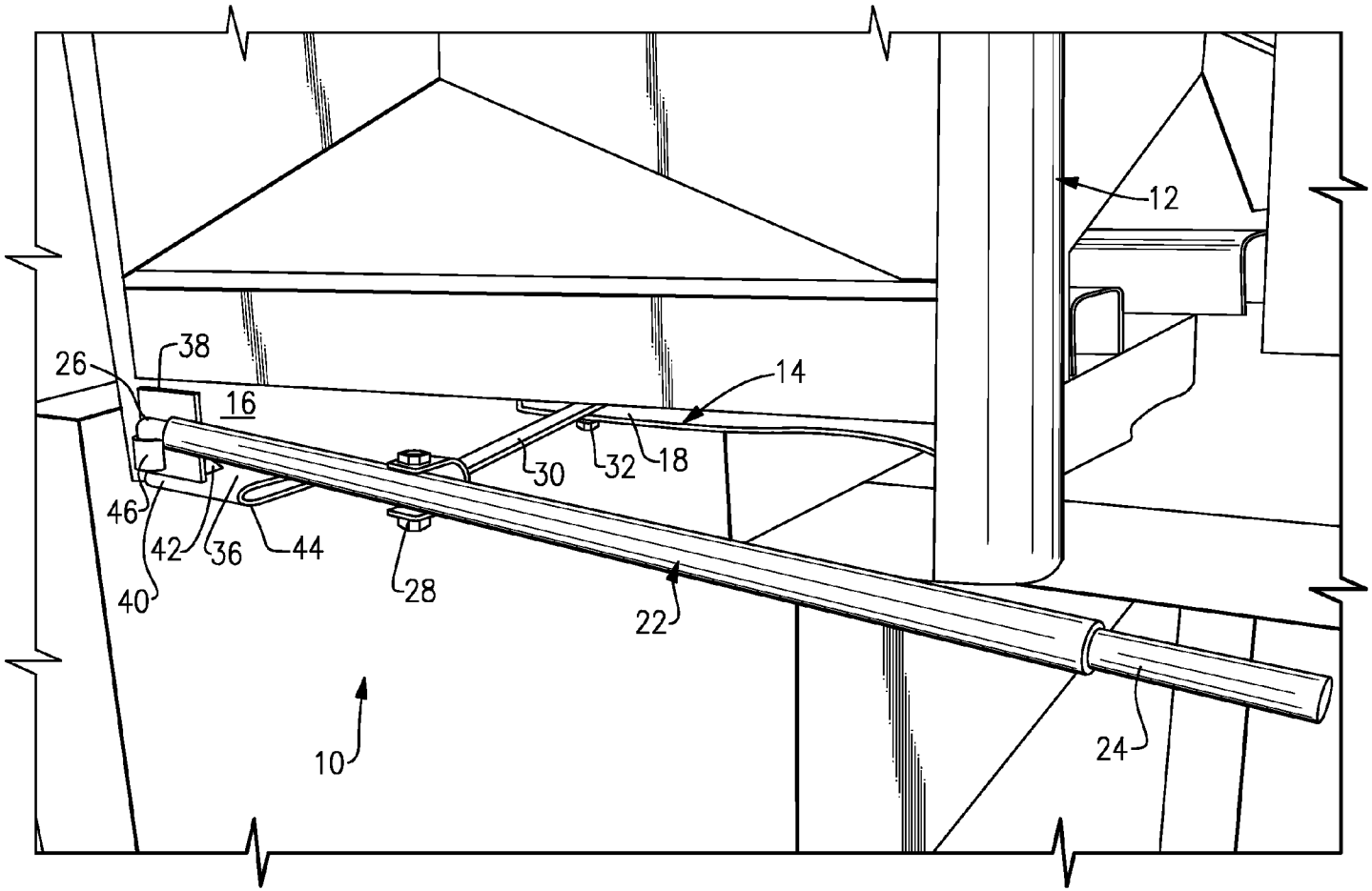
FIG. 7 illustrates a slide-gate opening system in its usage position in accordance with the invention.

With reference to FIG. 7, a slide-gate opening system 10 in its usage position on a shipping container 12 is initially described where the slide-gate 14 is closed. In one embodiment, the slide-gate opening system 10 includes the opener 20 and the attacher 34. In another embodiment, the attacher 34 is engaged into the forklift pocket 16 of shipping container 12 by attachment portion 44.

In one embodiment, the pivot point 26 is inserted into receiver 46. In another embodiment, the connector 32 is engaged with handhold 18 of the slide-gate 14.

Figure 8:
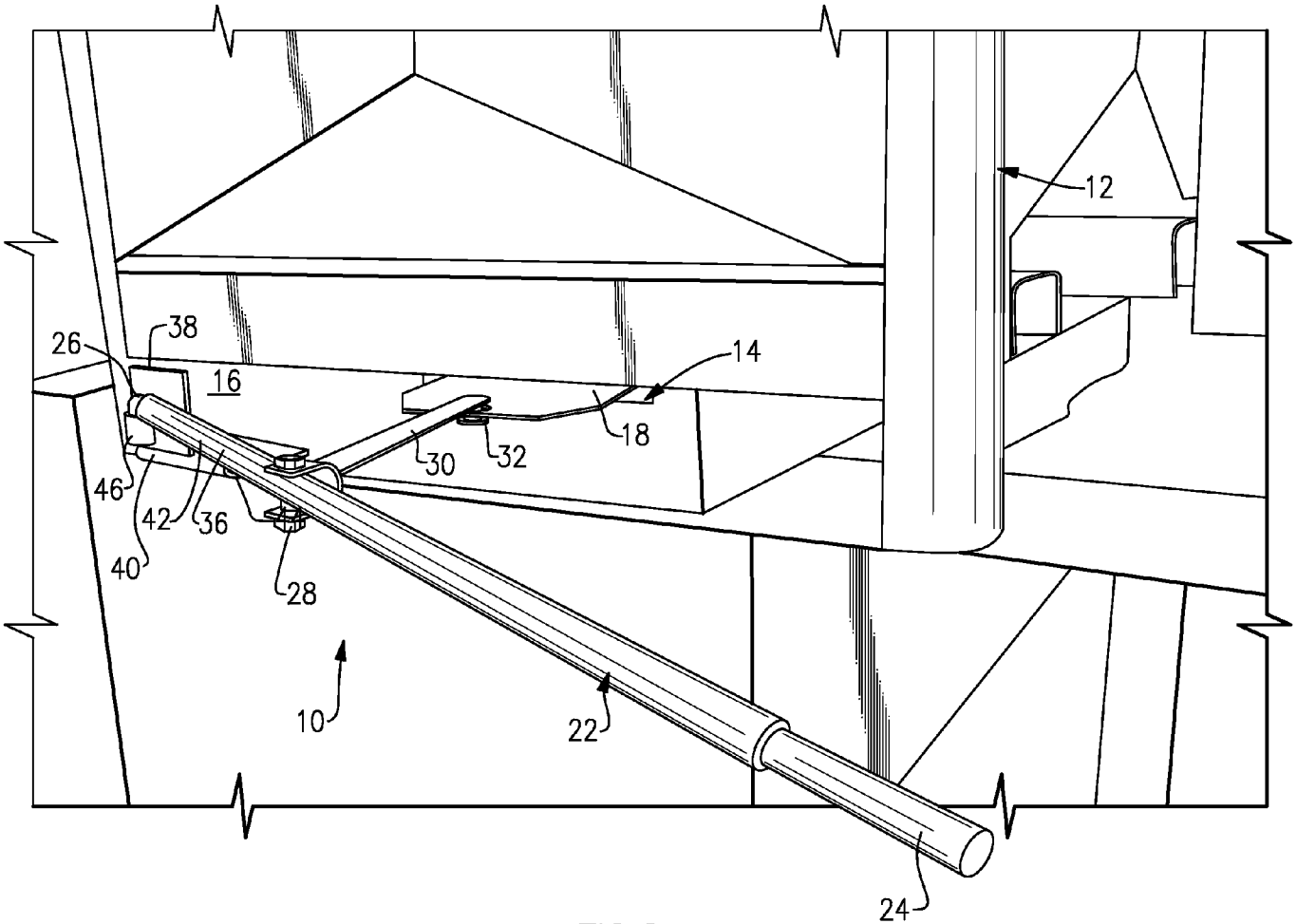
FIG. 8 illustrates the system of FIG. 7 opening the slide-gate of FIG. 2.
Figure 9:
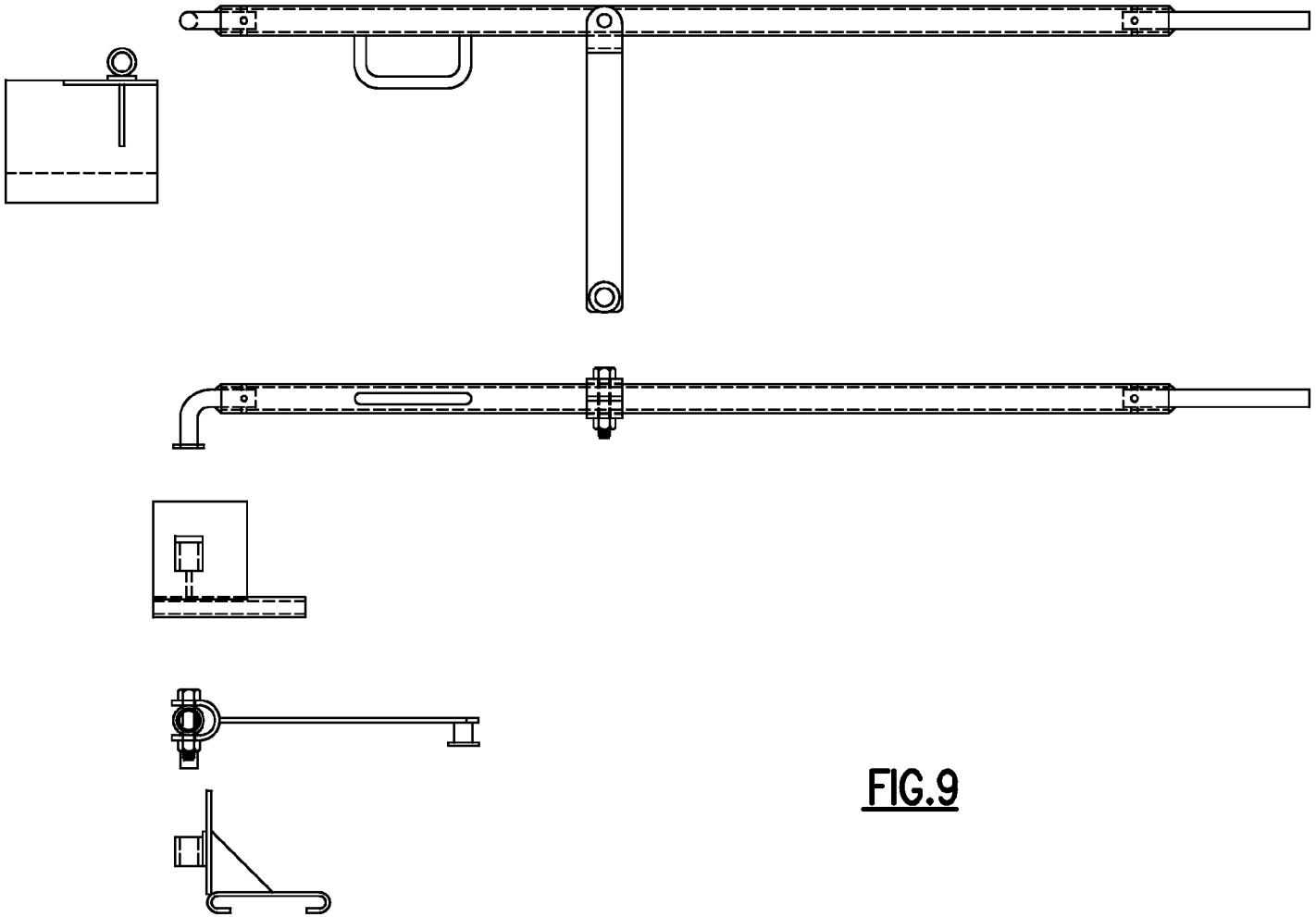
FIG. 9 includes isometric views of the slide-gate opening system of FIGS. 4 and 5.

In one embodiment, to open the slide-gate 14 of FIG. 7, a force is applied to handle 24 that moves the handle away from the shipping container 12 and in a direction which opens the slide-gate. The result of such an application of force to handle 24 is illustrated in FIG. 8 in which the slide-gate 14 is now in the open position due to the force exerted on handle 24 being transferred to connector 32 through joiner 28 and puller 30. In addition, during the foregoing slide-gate 14 opening process, pivot point 26 rotates in receiver 46. As a result, the slide-gate opening system 10 enables a user to open a slide-gate 14 on a shipping container 12 that is difficult to open.

In one embodiment, a system 10 to open a shipping bin 12 slide-gate 14 includes an opener 20, a pivot point 26 towards one end of the opener, and a handle 24 towards the other end of the opener. In another embodiment, the system 10 also includes a puller 30, a connector 32 towards one end of the puller, and a joiner 28 towards the other end of the puller that connects to the opener member 22.

In one embodiment, the system further includes an attacher 34 that engages a shipping container 12 and the pivot point 26, and the attacher transmits a force applied at the handle 24 to the connector 32 to open the slide-gate 14 carried by the shipping container. In another embodiment, the joiner 28 provides an adjustable connection to the opener 20.

In one embodiment, the system 10 additionally includes a receiver 46 carried by the attacher 34 that is sized to securely engage the pivot point 26, and the receiver enables the pivot point to rotate within the receiver. In another embodiment, the receiver 46 is a female fitting that mates with the pivot point 26, which is a male fitting.

In one embodiment, the system 10 also includes an attachment portion 44 carried by the attacher 34, and the attachment portion is sized to securely engage a forklift pocket 16 of the shipping container 12 in a first position and to be disengaged from the forklift pocket in a second position. In another embodiment, the attachment portion 44 envelopes a portion of a single side of the forklift pocket 16.

In one embodiment, the attacher 34 includes a first section that carries an attachment portion, a second section 38 that carries the receiver 46, and the first section connects to the second section 36, and the first section and the second section are not parallel to each other. In another embodiment, the system 10 further includes a buttress 42 that strengthens the connection between the first section 38 and the second section 36. In another embodiment, the connector 32 extends into a handhold 18 on the slide-gate 14 to enable the puller 30 to actuate the slide-gate.

Figure 10:
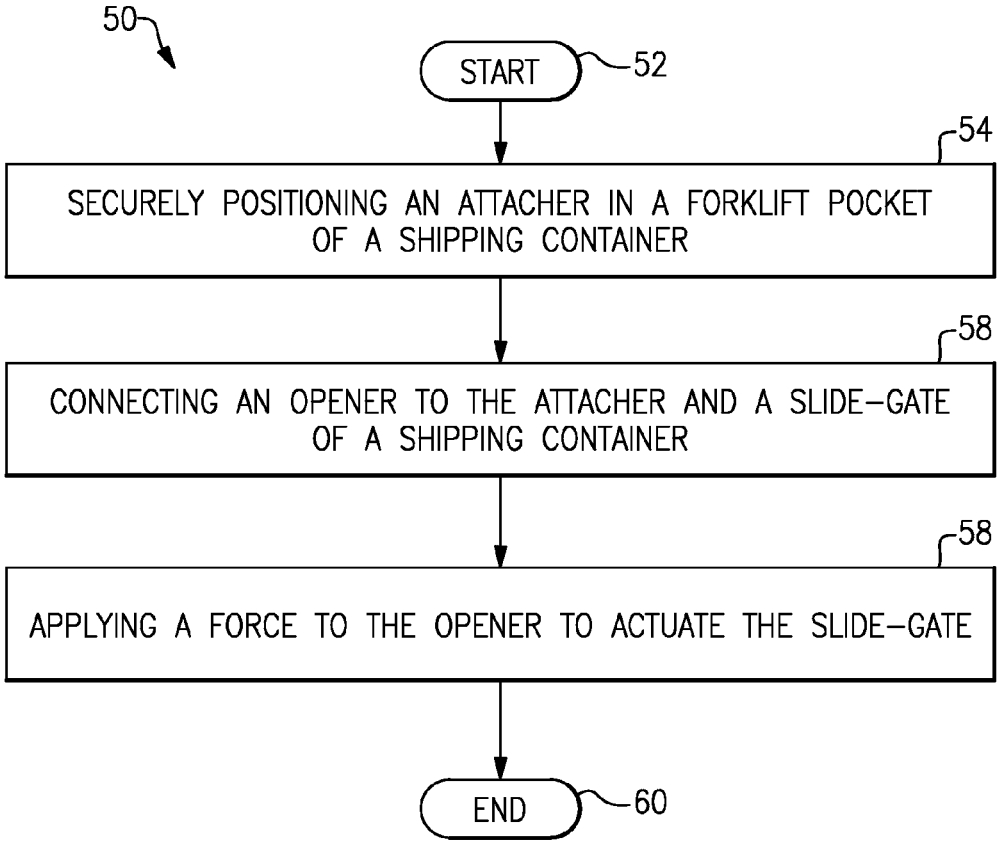
FIG. 10 is a flowchart illustrating method aspects according to the invention.

Another aspect of the invention is a method to open a shipping bin slide-gate which is now described with reference to flowchart 50 of FIG. 10. The method begins at Block 52 and may include securely positioning an attacher in a forklift pocket of a shipping container at Block 54. The method may also include connecting an opener to the attacher and a slide-gate of a shipping container at Block 56. The method may further include applying a force to the opener to actuate the slide-gate at Block 58. The method ends at Block 60.

Figure 11:
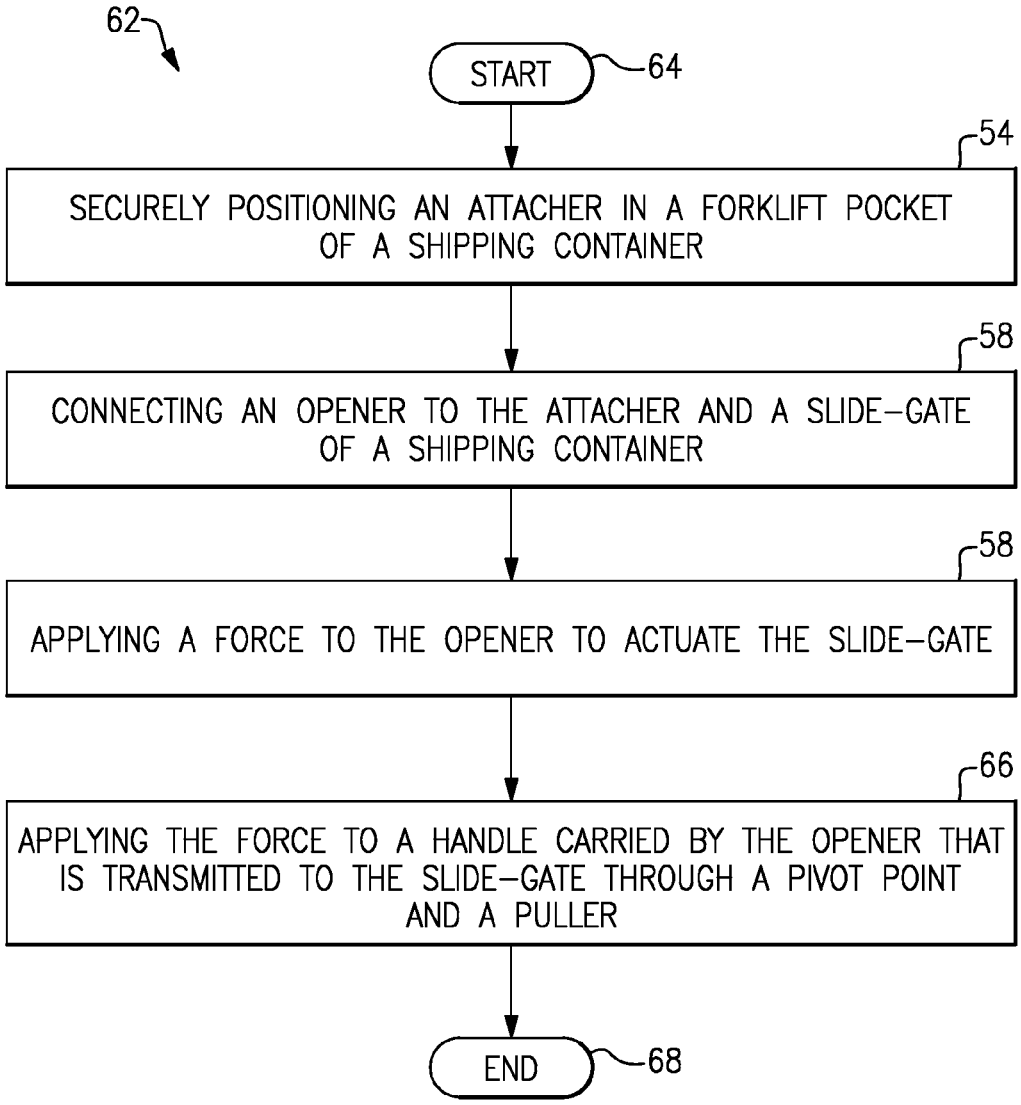
FIG. 11 is a flowchart illustrating method aspects according to the method of FIG. 10.

In another method embodiment, which is now described with reference to flowchart 62 of FIG. 11, the method begins at Block 64. The method may include the steps of FIG. 10 at Blocks 54, 56, and 58. The method may further include applying the force to a handle carried by the opener that is transmitted to the slide-gate through a pivot point and a puller at Block 66. The method ends at Block 68.

Figure 12:
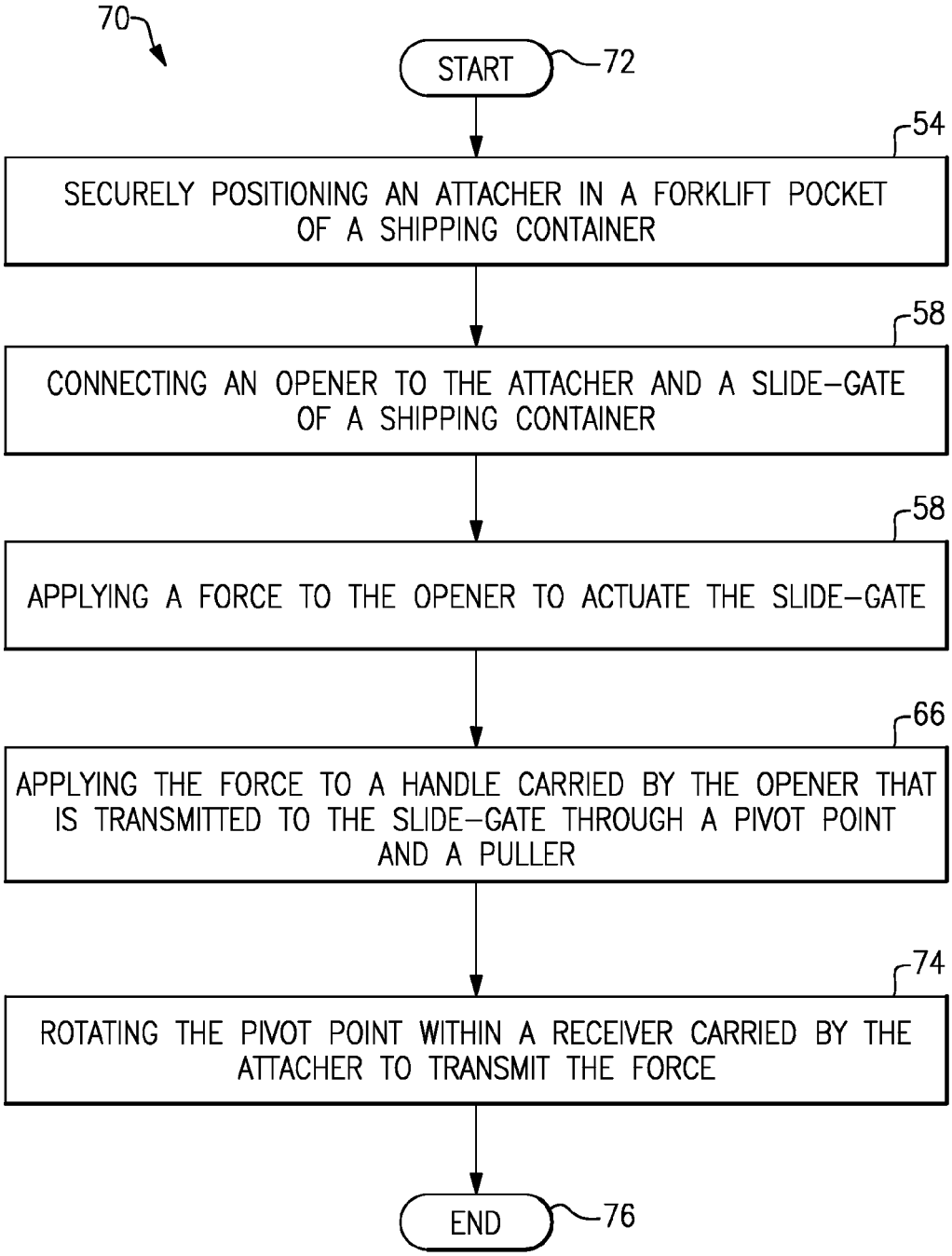
FIG. 12 is a flowchart illustrating method aspects according to the method of FIG. 11.

In another method embodiment, which is now described with reference to flowchart 70 of FIG. 12, the method begins at Block 72. The method may include the steps of FIG. 11 at Blocks 54, 56, 58, and 66. The method may further include rotating the pivot point within a receiver carried by the attacher to transmit the force at Block 74. The method ends at Block 76.

Figure 13:
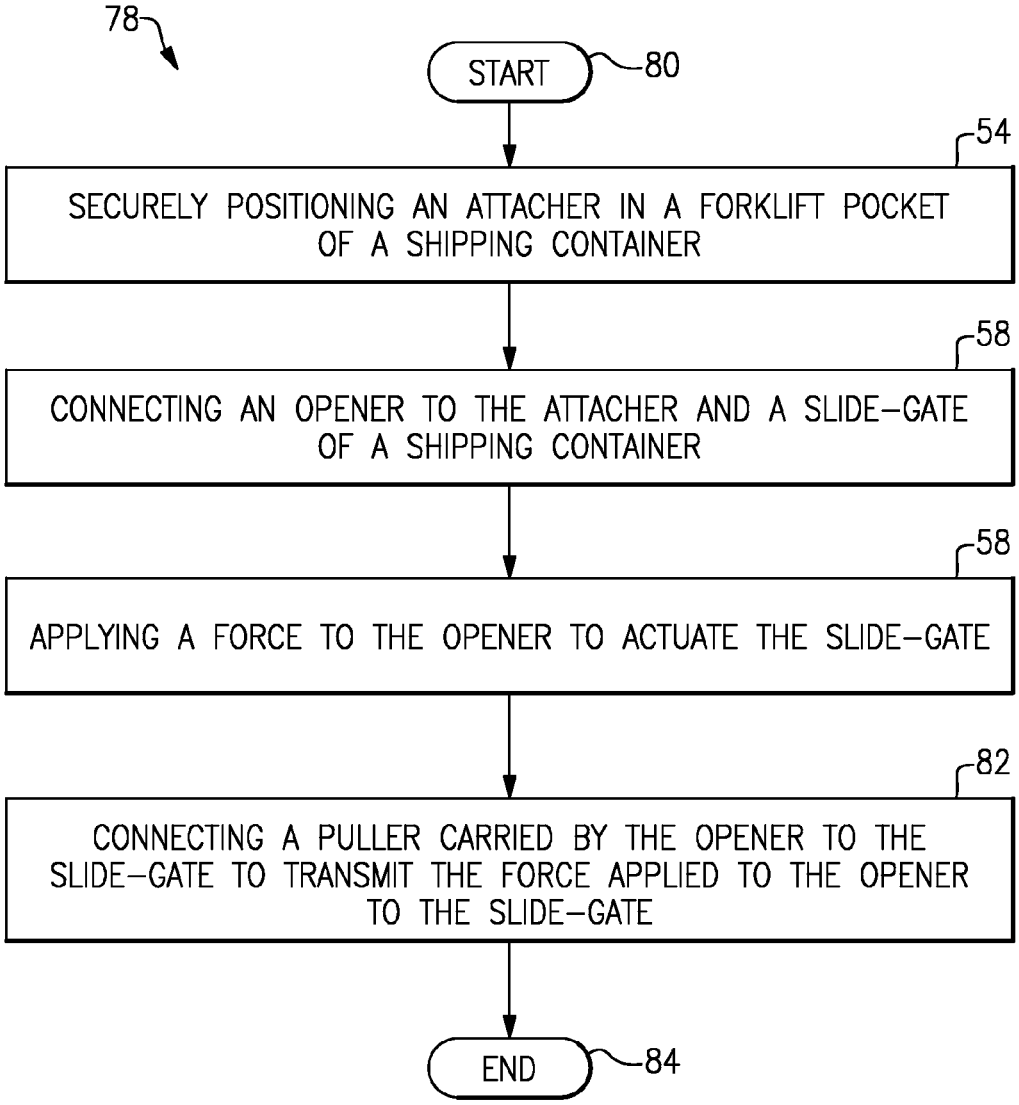
FIG. 13 is a flowchart illustrating method aspects according to the method of FIG. 10.

In another method embodiment, which is now described with reference to flowchart 78 of FIG. 13, the method begins at Block 80. The method may include the steps of FIG. 10 at Blocks 54, 56, and 58. The method may further include connecting a puller carried by the opener to the slide-gate to transmit the force applied to the opener to the slide-gate at Block 82. The method ends at Block 84.

Another aspect of the invention is a system 10 to open a shipping bin 12 slide-gate 14 that may include an opener member 22, a pivot point 26 towards one end of the opener member, and a handle 24 towards the other end of the opener member, in one embodiment. In another embodiment, the system 10 also includes a puller 30, a connector 32 towards one end of the puller and the connector extends into a handhold 18 on a slide-gate 14 to enable the puller to actuate the slide-gate, and a joiner 28 towards the other end of the puller that connects to the opener member 22.

In one embodiment, the system 10 further includes an attacher 34 that engages a shipping container 12 and the pivot point 26, and the attacher transmits a force applied at the handle 24 to the connector 32 to open the slide-gate carried by the shipping container. In another embodiment, the system 10 additionally includes a receiver 46 carried by the attacher 34 that is sized to securely engage the pivot point 26, and the receiver enables the pivot point to rotate within the receiver.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

It should be noted that in some alternative implementations, the functions noted in a flowchart block may occur out of the order noted in the figures. For instance, two blocks shown in succession may, in fact, be executed substantially concurrently, or the blocks may sometimes be executed in the reverse order, depending upon the functionality involved because the flow diagrams depicted herein are just examples. There may be many variations to these diagrams or the steps (or operations) described therein without departing from the spirit of the invention. For example, the steps may be performed concurrently and/or in a different order, or steps may be added, deleted, and/or modified. All of these variations are considered a part of the claimed invention.

What is claimed is:

1. A system for opening a slide-gate carried by a shipping container, the system comprising:

an opener member;

a pivot point towards one end of the opener member, the pivot point including a hook;

a handle towards the other end of the opener member;

a puller;

a connector towards one end of the puller;

a joiner towards the other end of the puller that connects to the opener member; and an attacher configured to engage the shipping container and receive the hook, the attacher transmits a force applied at the handle to the connector to open the slide-gate carried by the shipping container.

2. The system of claim 1 wherein the joiner provides an adjustable connection to the opener member.

3. The system of claim 1 further comprising a receiver carried by the attacher that is sized to securely engage the pivot point, and the receiver enables the pivot point to rotate within the receiver.

4. The system of claim 3 wherein the receiver is a female fitting that mates with the pivot point which is a male fitting.

5. The system of claim 1 further comprising an attachment portion carried by the attacher, the attachment portion sized to securely engage a forklift pocket of the shipping container in a first position and to be disengaged from the forklift pocket in a second position.

6. The system of claim 5 wherein the attachment portion configured to envelope a portion of a single side of the forklift pocket.

7. The system of claim 1 wherein the attacher comprises a first section that carries an attachment portion, a second section that carries a receiver, the first section connects to the second section, and the first section and the second section are not parallel to each other.

8. The system of claim 7 further comprising a buttress that strengthens the connection between the first section and the second section.

9. The system of claim 1 wherein the connector extends into a handhold on the slide-gate to enable the puller to actuate the slide-gate.

10. A method for opening a slide-gate carried by a shipping container, the method comprising:

securely positioning an attacher in a forklift pocket of a shipping container;

connecting an opener to the attacher and a slide-gate of a shipping container; and applying a force to the opener to actuate the slide-gate.

11. The method of claim 10 further comprising applying the force to a handle carried by the opener that is transmitted to the slide-gate through a pivot point and a puller.

12. The method of claim 11 further comprising rotating the pivot point within a receiver carried by the attacher to transmit the force.

13. The method of claim 10 further comprising connecting a puller carried by the opener to the slide-gate to transmit the force applied to the opener to the slide-gate.

14. A system comprising:

a shipping container;

a slide gate carried by the shipping container;

an opener member;

a pivot point towards one end of the opener member;

a handle towards the other end of the opener member;

a puller;

a connector towards one end of the puller, and the connector extends into a handhold on the slide-gate to enable the puller to actuate the slide-gate;

a joiner towards the other end of the puller that connects to the opener member;

an attacher that engages the shipping container and the pivot point, the attacher transmits a force applied at the handle to the connector to open the slide-gate carried by the shipping container; and a receiver carried by the attacher that is sized to securely engage the pivot point, and the receiver enables the pivot point to rotate within the receiver.

15. The system of claim 14 wherein the joiner provides an adjustable connection to the opener member.

16. The system of claim 14 wherein the receiver is a female fitting that mates with the pivot point which is a male fitting.

17. The system of claim 14 further comprising an attachment portion carried by the attacher, the attachment portion sized to securely engage a forklift pocket of the shipping container in a first position and to be disengaged from the forklift pocket in a second position.

18. The system of claim 17 wherein the attachment portion envelopes a portion of a single side of the forklift pocket.

19. The system of claim 14 wherein the attacher comprises a first section that carries an attachment portion, a second section that carries a receiver, the first section connects to the second section, and the first section and the second section are not parallel to each other.

20. The system of claim 19 further comprising a buttress that strengthens the connection between the first section and the second section.

* * * * *